US012258825B1

(12) United States Patent
Rowe et al.

(10) Patent No.: US 12,258,825 B1
(45) Date of Patent: Mar. 25, 2025

(54) AUTOMATED SAMPLE CLEANING

(71) Applicant: Halliburton Energy Services, Inc., Houston, TX (US)

(72) Inventors: Mathew Dennis Rowe, Houston, TX (US); Steven Robert Weiss, Houston, TX (US); Shaun Patrick Lawrence, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/397,878

(22) Filed: Dec. 27, 2023

(51) Int. Cl.
*E21B 21/06* (2006.01)
*E21B 49/08* (2006.01)

(52) U.S. Cl.
CPC ..... *E21B 21/066* (2013.01); *E21B 49/086* (2013.01)

(58) Field of Classification Search
CPC ..... E21B 49/00; E21B 49/005; E21B 49/086; E21B 21/066
See application file for complete search history.

(56) References Cited

U.S. PATENT DOCUMENTS 4,606,283 A * 8/1986 DesOrmeaux ..... F23G 5/04 219/390
9,651,468 B2 5/2017 Rowe et al.
9,765,617 B2 9/2017 Gosney et al.
9,857,289 B2 1/2018 Rowe et al.
10,047,604 B2 8/2018 Graves et al.
10,145,229 B2 12/2018 Galliano et al.
10,352,845 B2 7/2019 Rowe et al.
11,280,175 B2 3/2022 Rowe
11,401,806 B2 8/2022 Rowe et al.
11,519,265 B2 12/2022 Rowe et al.
11,795,819 B2 10/2023 Rowe
2012/0090898 A1* 4/2012 Ross ..... E21B 21/068 175/66
2012/0217065 A1 8/2012 Gray
2013/0270011 A1* 10/2013 Akkurt ..... E21B 49/088 175/58
2014/0175008 A1* 6/2014 Mathis ..... E21B 21/066 210/768
2016/0273355 A1 9/2016 Gosney et al.
2016/0370274 A1 12/2016 Rowe et al.
2017/0108428 A1 4/2017 Rowe et al.
2019/0063215 A1* 2/2019 Dai ..... H03M 7/3062
2019/0338637 A1* 11/2019 Francois ..... E21B 49/08
2020/0408090 A1* 12/2020 Kadayam Viswanathan ..... E21B 49/02
2021/0047911 A1 2/2021 Rowe
2022/0268153 A1* 8/2022 Mezghani ..... E21B 47/0025
(Continued)

OTHER PUBLICATIONS

International Search Report and Written Opinion for International Patent Application No. PCT/US2023/086539 dated Sep. 23, 2024. PDF file. 8 pages.

*Primary Examiner* — Kristyn A Hall
(74) *Attorney, Agent, or Firm* — Benjamin Ford; C. Tumey Law Group PLLC

(57) ABSTRACT

Disclosed herein are automated sample cleaning systems and processes after collection of the drilling cuttings from the shale shaker. These automated sample cleaning systems and processes help in delivering a drilling cutting sample that has been cleaned following the same procedure from one drill rig site to another providing consistency on its impact on the compositional analysis of the drilling cutting sample.

19 Claims, 2 Drawing Sheets

(56) References Cited

U.S. PATENT DOCUMENTS

| | | | |
|---|---|---|---|
| 2022/0307370 | A1 | 9/2022 | Rowe et al. |
| 2023/0078728 | A1 | 3/2023 | Kadayam Viswanathan et al. |
| 2023/0160269 | A1 | 5/2023 | Mezghani et al. |

* cited by examiner

AUTOMATED SAMPLE CLEANING

BACKGROUND

A natural resource such as oil or gas residing in a subterranean formation can be recovered by drilling a wellbore into the formation. A wellbore is typically drilled while circulating a drilling fluid through the wellbore. The various functions of a drilling fluid include removing drill cuttings from the wellbore, cooling and lubricating the drill bit, aiding in support of the drill pipe and drill bit, and providing a hydrostatic head to maintain the integrity of the wellbore walls and preventing well blowouts. Drilling fluids often include a plurality of particles that impart properties such as viscosity, density, and capabilities such as wellbore strengthening. Drilling fluid density is controlled such that the drilling fluid provides enough hydrostatic pressure to prevent invasion of formation fluids into the wellbore while not exceeding the fracture gradient of the formation thereby preventing fracturing of the formation. Weighting agents and viscosifiers can be used to produce drilling fluids with a desired viscosity, which affects the pumpability and equivalent circulating density of the drilling fluid. As the drilling fluid is pumped through a drill string and out a drill bit, contact is made between the drilling fluid and the wellbore walls as drilling fluid flows upwards to the surface.

As a well is being drilled, the rock undergoing the drilling is cut or otherwise fragmented into small pieces, called "cuttings" that are removed from the bulk of the formation via the drilling fluid. The process is similar to drilling a hole in a piece of wood which results in the wood being cut into shavings and/or sawdust. Cuttings are representative of the reservoir rock. Although they have been altered by the drilling process, they may provide an understanding of the reservoir rock properties. This is often referred to as "mud logging" or "cuttings evaluation." At surface, cuttings can be removed from the drilling fluid at the shale shaker. A shale shaker is part of the solids control system on a drilling rig site and is used to remove relatively large solids (i.e., cuttings) from the drilling fluid or mud. The shale shaker is a vibrating mesh with a chosen opening which collects the cuttings at the top while mud falls through it. The shaker screen selection has the largest impact on the overall performance of the shale shaker. The collected cuttings may be analyzed to estimate the reservoir quality such as porosity, permeability, hydrocarbon content and type, for example.

BRIEF DESCRIPTION OF THE DRAWINGS

This drawing illustrates certain aspects of some of the embodiments of the present disclosure and should not be used to limit or define the disclosure.

DETAILED DESCRIPTION

Disclosed herein are automated sample cleaning systems and processes after collection of the drilling cuttings from the shale shaker. These automated sample cleaning systems and processes help in delivering a drilling cutting sample that has been cleaned following the same procedure from one drill rig site to another providing consistency on its impact on the compositional analysis of the drilling cutting sample.

Figure 1:
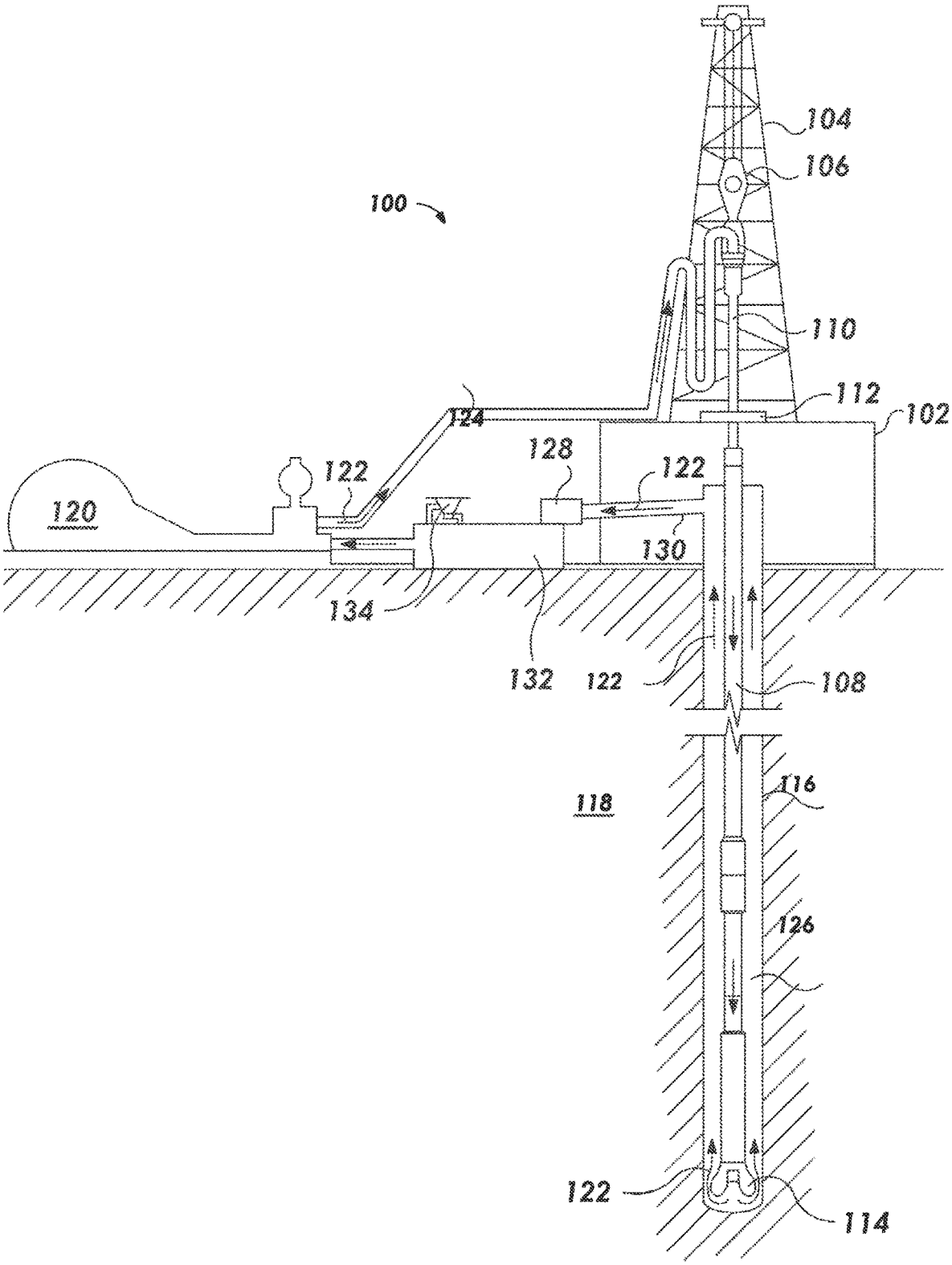
FIG. 1 illustrates a drilling assembly in accordance with some embodiments of the present disclosure.

FIG. 1 illustrates a drilling assembly in accordance with some embodiments of the present disclosure. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated in FIG. 1, the drilling assembly 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A drill bit 114 is attached to the distal end of the drill string 108 and is driven either by a downhole motor and/or via rotation of the drill string 108 from the well surface. As the drill bit 114 rotates, it creates a wellbore 116 that penetrates various subterranean formations 118.

A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the wellbore 116. At the surface, the recirculated or spent drilling fluid 122 exits the annulus 126 and may be conveyed to one or more fluid processing unit(s) 128 via an interconnecting flow line 130. After passing through the fluid processing unit(s) 128, a "cleaned" drilling fluid 122 is deposited into a nearby retention pit 132 (e.g., a mud pit). While illustrated as being arranged at the outlet of the wellbore 116 via the annulus 126, those skilled in the art will readily appreciate that the fluid processing unit(s) 128 may be arranged at any other location in the drilling assembly 100 to facilitate its proper function, without departing from the scope of the disclosure. A mixing hopper 134 is communicably coupled to or otherwise in fluid communication with the retention pit 132. The mixing hopper 134 may include, but is not limited to, mixers and related mixing equipment known to those skilled in the art. The fluid processing unit(s) 128 may include one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, and any fluid reclamation equipment. The fluid processing unit(s) 128 may further include one or more sensors, gauges, pumps, compressors, and the like used to store, monitor, regulate, and/or recondition the drilling fluid.

Figure 2:
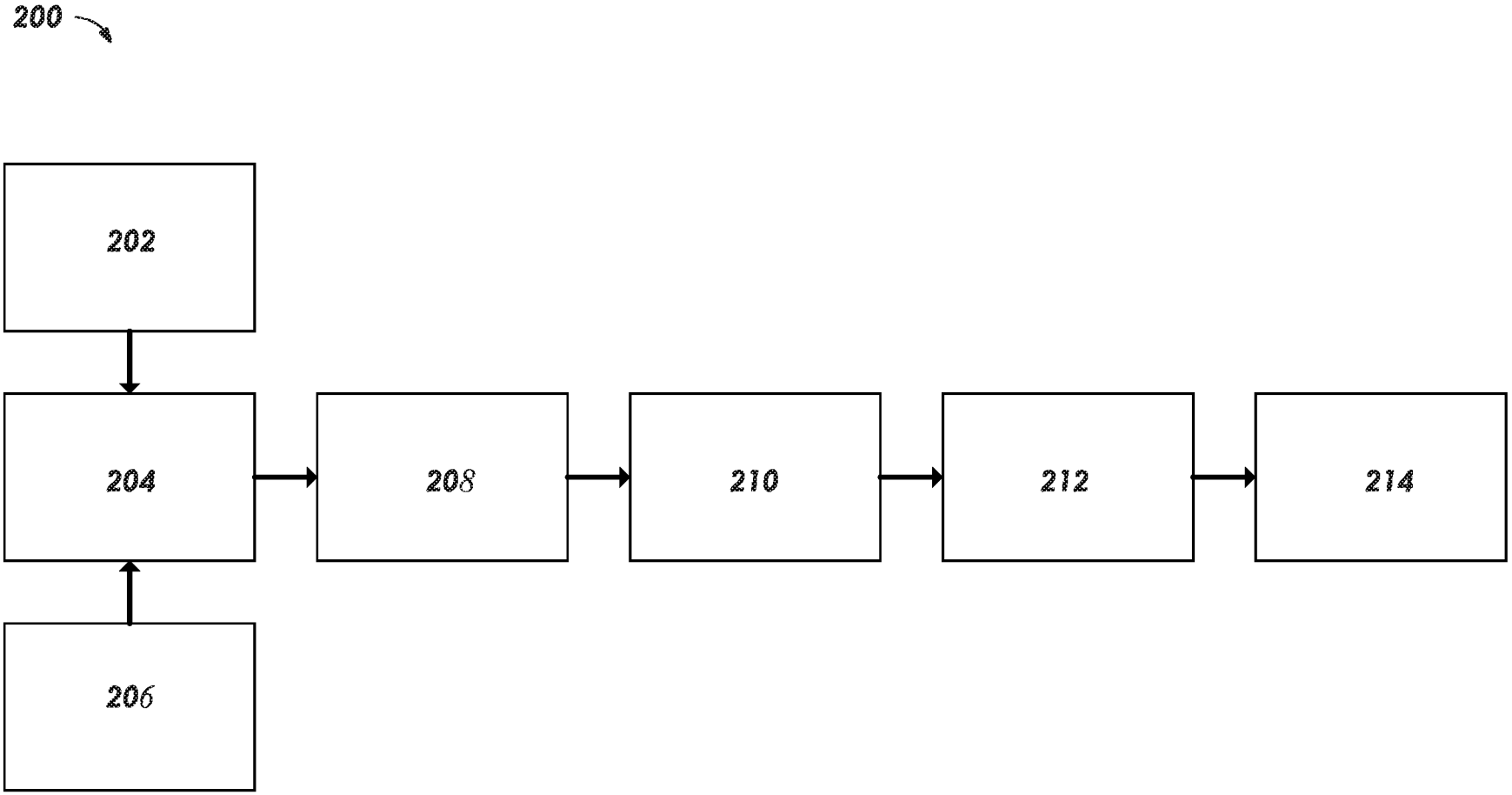
FIG. 2 is a schematic of an automated sample cleaning process in accordance with some embodiments of the present disclosure.

FIG. 2 is a schematic of an automated sample cleaning process 200 in accordance with some embodiments of the present disclosure. In step 202, a person collects a drilling cutting sample from the shale shaker in fluid processing unit 128 (referring to FIG. 1). The drilling cutting sample may be from 1 mm to 2 cm in size and placed inside a 50 cc wet bag, for example. In step 204, the drilling cutting sample is then loaded into a receiving chamber and its identification entered into the analysis system in identification step 206. Its identification may be the depth at which the drilling cutting sample has been collected, the drilling fluid it has been exposed to, and/or the temperature and/or pressure, for example. The identification may be entered into the system and the sample labelled with a bar code, a Q-code, a MEMS, or any suitable label that can indicate the drilling cutting identity and/or information pertinent to the sample cutting collection. After the drilling cutting sample has been loaded into receiving chamber in step 204 and its identification step 206 performed as well, the drilling cutting sample is transported automatically from the receiving chamber in step 204 to the rinsing chamber for step 208 by a conveyor push mechanism, for example. The conveyor push mechanism may be any suitable mechanism that can transport automatically any drilling cutting sample from the receiving chamber in step 204 to the rinsing chamber for step 208.

The drilling cutting sample is then rinsed inside the rinsing chamber in step 208 using the base fluid of the drilling fluid, i.e., using the same base oil that has been used to make the oil-based drilling fluid, for example. The rinsing performed by the same base oil in rinsing chamber in step 208 should remove any excess of drilling fluid, calcium carbonate, baroid, and/or any component of the returning drilling fluid. The base fluid may be diesel oil or any synthetic oil that has been used to make the oil-based drilling fluid, for example. The excess fluid is drained away from rinsing chamber in step 208 but may be analyzed afterward.

After step 208, the drilling cutting sample is then transported automatically from rinsing chamber to the spin drier chamber for step 210. The drilling cutting sample may be transported automatically from the rinsing chamber after step 208 to the spin drier chamber for step 210 by a conveyor push mechanism, for example. The conveyor push mechanism may be any suitable mechanism that can transport automatically any drilling cutting sample from the rinsing chamber to the spin drier chamber.

Step 210 includes a spinning step and a heating step. The spinning step and the heating step may be performed simultaneously or alternatively. In step 210, the spinning and drying chamber may use any mechanism to spin the drilling cutting sample and any mechanism to dry the drilling cutting sample. The spinning mechanism may be any mechanical means to rotate the drilling cutting sample at a controlled spin such as a centrifuge, for example. The cutting sample may be placed in a centrifuge at 100 rpm, 200 rpm, 400 rpm, 500 rpm, 750 rpm, 1000 rpm or every number in between for 30 seconds, for 1 minute, for 2 minutes, for 5 minutes, for 10 minutes, or for 20 minutes before, during, and/or after the heating step, for example. The mechanism to dry the drilling cutting sample may be performed by successive steps, i.e., by heating and maintaining the temperature of the drilling cutting sample at different temperatures in different steps defined by their rate of heating, their temperature and time maintained at a specific temperature.

In step 210, the drilling cutting sample may be heated to 30° C., to 40° C., or to 50° C., with a rate increase of 1° C., 2° C., or 5° C. per minute, for example, from ambient temperature and then the temperature is maintained at 30° C., at 40° C., or at 50° C. for 10 minutes, 30 minutes, or 60 minutes, for example.

The spinning and drying chamber used in step 210 includes a vent that may be connected to at least one sensor to analyze and identify the gas vented during the spinning and heating steps. The at least one sensor may be any analytical equipment capable of analyzing the gas vented during these steps such as an infrared spectrometer, a Fourier-Transformed infrared spectrometer, a UV-Vis spectrometer, a mass spectrometer, a gas chromatography-mass spectrometer, but also any analytical equipment capable of measuring humidity such as conductivity, catalytic bed, for example.

Step 212 consists of drying the drilling cutting sample only. Step 212 may be performed in a drying chamber separated from the spinning and drying chamber of step 210 or step 212 may be performed in the same spinning and drying chamber used for step 210 but without using the spinning step. If the drying chamber of step 212 is separated from the spinning and drying chamber of step 210, the drilling cutting sample is transported automatically from the spinning and drying chamber of step 210 to the drying chamber for step 212. The drilling cutting sample may be transported automatically from the spinning and drying chamber of step 210 to the drying chamber for step 212 by a conveyor push mechanism, for example. The conveyor push mechanism may be any suitable mechanism that can transport automatically any drilling cutting sample from the spinning and drying chamber of step 210 to the drying chamber for step 212.

The drying chamber of step 212 includes any electrical heater that can heat the drilling cutting sample at a controlled rate and maintain at a specific temperature the drilling cutting sample. The drilling cutting sample may be then heated to 50° C. with a rate increase of 1° C. per minute for example from 30° C., or 40° C. then the temperature is maintained at 50° C. for 60 minutes, for example. The cutting sample may be then heated to 80° C. with a rate increase of 2° C. per minute, for example, from 60° C. then the temperature is maintained at 80° C. for 30 minutes, for example. Alternatively, the cutting sample may be heated to 60° C. with a rate increase of 5° C. per minute from 30° C., 40° C., or 50° C. then the temperature is maintained at 60° C. for 10 minutes, for example. The cutting sample may be then heated to 80° C. with a rate increase of 5° C. per minute from 60° C. then the temperature is maintained at 80° C. for 10 minutes, for example. The drilling cutting sample is heated to 100° C. with a rate increase of 5° C. per minute from ambient temperature then the temperature is maintained at 100° C. for 10 minutes, for example. A vent is connected to the drying chamber of step 212 to collect the gas molecules coming off the heated cutting sample during the ramp up of the temperature and when the cutting sample is maintained at a specific temperature, 100° C. for example. The vent may be connected to at least one sensor to analyze and identify the gas vented during the heating steps. The at least one sensor may be any analytical equipment capable of analyzing the gas vented during these steps such as an infrared spectrometer, a Fourier-Transformed infrared spectrometer, a UV-Vis spectrometer, a mass spectrometer, a gas chromatography-mass spectrometer, but also any analytical equipment capable of measuring humidity such as conductivity, catalytic bed, for example. The at least one sensor is connected to the heater to correlate the composition analysis to the heating temperature of the cutting sample.

In step 214, the drilling cutting sample is analyzed either at the drilling rig site or offsite in a laboratory. If the drilling cutting sample is analyzed on-site, the drilling cutting sample is transported automatically from the drying chamber of step 212 to the analyzing chamber for step 214. The drilling cutting sample may be transported automatically from the drying chamber of step 212 to the analyzing chamber for step 214 by a conveyor push mechanism, for example. The conveyor push mechanism may be any suitable mechanism that can transport automatically any drilling cutting sample from the drying chamber of step 212 to the analyzing chamber for step 214. The analyzing chamber for step 214 includes any analytical equipment capable of analyzing solid rock (i.e., the drilling cutting sample) such as automated X-Ray fluorescence elemental analysis, visible and UV fluorescence, diffuse reflectance Fourier-Transformed infrared spectroscopy, hyperspectral imaging, Raman spectroscopy, FT-IR, XRF, Tetra hertz spectroscopy, ICP-OES, ICP-MS, optical microscopy, UV spectroscopy, for example. The drilling cutting sample may be collected after on-site analysis for further off-side analysis or for recording. The analyzed drilling cutting sample may be transported out of the analyzing chamber of step 214 automatically by a conveyor push mechanism, for example. Alternatively, step 214 may consist of the operator collecting the drilling cutting sample for off-site analysis.

Each chamber involved in steps 204 to 214 may be automatically cleaned by jet spraying or any means of spraying any cleaning chemical such as acetone inside the chamber in contact with the drilling cutting sample that may interfere with the following analysis of the next drilling cutting sample.

Accordingly, the present disclosure may provide methods, systems, and apparatus that may relate to automated sample cleaning systems and processes after collection of the drilling cuttings from the shale shaker. The methods, systems. and apparatus may include any of the various features disclosed herein, including one or more of the following statements.

Statement 1. A method of cleaning automatically a drilling cutting from a return reservoir drilling fluid comprising: collecting the drilling cutting from a drilling fluid processing unit; loading the drilling cutting into a receiving chamber; identifying and labeling the drilling cutting; rinsing the drilling cutting automatically in a rinsing chamber; spinning the drilling cutting automatically in a spinning and drying chamber; drying the drilling cutting automatically emitting gases from the drilling cutting; analyzing the emitted gases; and analyzing the drilling cutting after drying.

Statement 2. The method of cleaning of Statement 1, further transporting automatically the drilling cutting from the receiving chamber into the rinsing chamber.

Statement 3. The method of cleaning of Statement 1 or Statement 2, further transporting automatically the drilling cutting from the rinsing chamber into the spinning and drying chamber.

Statement 4. The method of cleaning of any one of Statements 1-3, wherein the rinsing is performed using the same base fluid as the base fluid used to make the drilling fluid.

Statement 5. The method of cleaning of any one of Statements 1-4, wherein the rotational spring comprises a spiral torsion spring disposed about the first armature.

Statement 6. The method of cleaning of any one of Statements 1-5, wherein a liquid used for rinsing the drilling cutting is drained away and recovered for analysis.

Statement 7. The method of cleaning of any one of Statements 1-6, wherein drying the drilling cutting automatically comprises heating to 50° C. with a rate increase of 1° C. per minute from ambient temperature, maintaining the temperature at 50° C. for 60 minutes, then heating to 80° C. with a rate increase of 2° C. per minute from 50° C., maintaining the temperature at 80° C. for 30 minutes.

Statement 8. The method of cleaning of any one of Statements 1-7, wherein drying the drilling cutting automatically comprises using an electrical heater.

Statement 9. The method of cleaning of any one of Statements 1-8, wherein analyzing the drilling cutting after drying is performed on site.

Statement 10. The method of cleaning of any one of Statements 1-9, further transporting automatically the drilling cutting after drying from the spinning and drying chamber to a drying chamber for another drying step.

Statement 11. The method of cleaning of any one of Statements 1-10, further transporting automatically the drilling cutting after drying from the spinning and drying chamber to a drying chamber for another drying step, transporting the drilling cutting from the drying chamber to an analyzing chamber automatically.

Statement 12. The method of cleaning of any one of Statements 1-11, wherein the analyzing chamber comprises at least one analytical equipment selected from the group consisting of automated X-Ray fluorescence spectrometer, visible and UV fluorescence spectrometer, diffuse reflectance Fourier Transform infrared spectrometer, hyperspectral imaging system, Raman spectrometer, FTIR spectrometer, Tetra hertz spectrometer, ICP-OES, ICP-MS, optical microscope, UV spectrometer.

Statement 13. The method of cleaning of any one of Statements 1-12, wherein the analyzing chamber comprises an optical spectrometer.

Statement 14. A system for cleaning automatically a drilling cutting from a return reservoir drilling fluid comprising: a receiving chamber; a rinsing chamber; a spinning chamber and drying chamber; and a conveyor push mechanism.

Statement 15. The system of Statement 14, wherein the conveyor push mechanism connects the receiving chamber to the rinsing chamber to the spinning and drying chamber.

Statement 16. The system of Statement 14 or Statement 15, further comprising a drying chamber.

Statement 17. The system of any one of Statements 14-16, further comprising an analyzing chamber connected to the spinning and drying chamber.

Statement 18. The system of any one of Statements 14-17, further comprising a drying chamber and an analyzing chamber, wherein the drying chamber is connected to the spinning and drying chamber and the analyzing chamber is connected to the drying chamber.

Statement 19. The system of any one of Statements 14-18, further comprising an analyzing chamber comprising at least one analytical equipment selected from the group consisting of automated X-Ray fluorescence spectrometer, visible and UV fluorescence spectrometer, diffuse reflectance Fourier Transform infrared spectrometer, hyperspectral imaging system, Raman spectrometer, FTIR spectrometer, Tetra hertz spectrometer, ICP-OES, ICP-MS, optical microscope, UV spectrometer.

Statement 20. The system of any one of Statements 14-19, further comprising a vent connected to the drying chamber, wherein the vent collects the gases emitted by the drilling cutting upon drying and the vent is connected to an analytical equipment.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method of cleaning automatically a drilling cutting from a return reservoir drilling fluid comprising:

collecting the drilling cutting from a drilling fluid processing unit;

loading the drilling cutting into a receiving chamber;

identifying and labeling the drilling cutting;

rinsing the drilling cutting automatically in a rinsing chamber, wherein a liquid used for rinsing the drilling cutting is drained away and recovered for analysis;

spinning the drilling cutting automatically in a spinning and drying chamber;

drying the drilling cutting automatically emitting gases from the drilling cutting;

analyzing the emitted gases; and analyzing the drilling cutting after drying.

2. The method of claim 1, further transporting automatically the drilling cutting from the receiving chamber into the rinsing chamber.

3. The method of claim 1, further transporting automatically the drilling cutting from the rinsing chamber into the spinning and drying chamber.

4. The method of claim 1, wherein the rinsing is performed using a base fluid used to make the reservoir drilling fluid.

5. The method of claim 1, wherein spinning the drilling cutting comprises automatically placing the drilling cutting into a centrifuge and spinning at 100 rpm for 30 seconds.

6. The method of claim 1, wherein drying the drilling cutting automatically comprises heating to 50° C. with a rate increase of 1° C. per minute from ambient temperature, maintaining the temperature at 50° C. for 60 minutes, then heating to 80° C. with a rate increase of 2° C. per minute from 50° C., maintaining the temperature at 80° C. for 30 minutes.

7. The method of claim 1, wherein drying the drilling cutting automatically comprises using an electrical heater.

8. The method of claim 1, wherein analyzing the drilling cutting after drying is performed on site.

9. The method of claim 8, further transporting automatically the drilling cutting after drying from the spinning and drying chamber to a drying chamber for another drying step.

10. The method of claim 1, further transporting automatically the drilling cutting after drying from the spinning and drying chamber to a drying chamber for another drying step, transporting the drilling cutting from the drying chamber to an analyzing chamber automatically.

11. The method of claim 10, wherein the analyzing chamber comprises at least one analytical equipment selected from the group consisting of automated X-Ray fluorescence spectrometer, visible and UV fluorescence spectrometer, diffuse reflectance Fourier Transform infrared spectrometer, hyperspectral imaging system, Raman spectrometer, FTIR spectrometer, Tetra hertz spectrometer, ICP-OES, ICP-MS, optical microscope, UV spectrometer.

12. The method of claim 10, wherein the analyzing chamber comprises an optical spectrometer.

13. A system for cleaning automatically a drilling cutting from a return reservoir drilling fluid comprising:

a receiving chamber;

a rinsing chamber;

a spinning and drying chamber;

a vent connected to the spinning and drying chamber, wherein the vent collects gases emitted by the drilling cutting upon drying and the vent is connected to an analytical equipment, and a conveyor push mechanism.

14. The system of claim 13, wherein the conveyor push mechanism connects the receiving chamber to the rinsing chamber to the spinning chamber and drying chamber.

15. The system of claim 13, further comprising a separate drying chamber.

16. The system of claim 13, further comprising an analyzing chamber connected to the spinning chamber and drying chamber.

17. The system of claim 13, further comprising a drying chamber and an analyzing chamber, wherein the drying chamber is connected to the spinning chamber and drying chamber and the analyzing chamber is connected to the drying chamber.

18. The system of claim 13, further comprising an analyzing chamber comprising at least one analytical equipment selected from the group consisting of automated X-Ray fluorescence spectrometer, visible and UV fluorescence spectrometer, diffuse reflectance Fourier Transform infrared spectrometer, hyperspectral imaging system, Raman spectrometer, FTIR spectrometer, Tetra hertz spectrometer, ICP-OES, ICP-MS, optical microscope, UV spectrometer.

19. A method of cleaning automatically a drilling cutting from a return reservoir drilling fluid comprising:

collecting the drilling cutting from a drilling fluid processing unit;

loading the drilling cutting into a receiving chamber;

identifying and labeling the drilling cutting;

rinsing the drilling cutting automatically in a rinsing chamber;

spinning the drilling cutting automatically in a spinning and drying chamber;

drying the drilling cutting automatically emitting gases from the drilling cutting, wherein drying the drilling cutting automatically comprises heating to 50° C. with a rate increase of 1° C. per minute from ambient temperature, maintaining the temperature for 50° C. for 60 minutes, the heating 80° C. with a rate increase of 2° C. per minute from 50° C., maintaining the temperature at 80° C. for 30 minutes, analyzing the emitted gases; and analyzing the drilling cutting after drying.

* * * * *